United States Patent [19]

Ziolo

[11] Patent Number: 4,474,866

[45] Date of Patent: Oct. 2, 1984

[54] DEVELOPER COMPOSITION CONTAINING SUPERPARAMAGNETIC POLYMERS

[75] Inventor: Ronald F. Ziolo, Webster, N.Y.

[73] Assignee: Xerox Corporation, Stamford, Conn.

[21] Appl. No.: 536,806

[22] Filed: Sep. 28, 1983

[51] Int. Cl.[3] ..... G03G 9/14; G03G 9/08

[52] U.S. Cl. ..... 430/106.6; 430/137; 430/903; 430/126; 252/62.54; 252/62.56

[58] Field of Search ..... 430/106.6, 109, 110, 430/903, 137; 252/62.54, 62.56

[56] References Cited

U.S. PATENT DOCUMENTS

| | | | |
|---|---|---|---|
| 3,634,251 | 1/1972 | Maeda et al. | 430/137 |
| 3,804,764 | 4/1974 | Strella et al. | 430/109 |
| 4,150,173 | 4/1979 | Ziolo | 427/130 |
| 4,189,224 | 2/1980 | Sakai | 355/4 |
| 4,230,787 | 10/1980 | Watanabe et al. | 430/107 |
| 4,238,558 | 12/1980 | Ziolo | 430/100 |
| 4,282,302 | 8/1981 | Makino et al. | 430/107 |
| 4,284,700 | 8/1981 | Oguchi et al. | 430/105 |
| 4,288,519 | 9/1981 | Diamond et al. | 430/137 |

FOREIGN PATENT DOCUMENTS

| | | | |
|---|---|---|---|
| 2921364 | 11/1979 | Fed. Rep. of Germany | 430/106.6 |
| 55-6344 | 1/1980 | Japan | 430/106.6 |

*Primary Examiner*—Roland E. Martin

*Attorney, Agent, or Firm*—E. O. Palazzo

[57] ABSTRACT

A color magnetic single component toner composition possessing a magnetic saturation moment of from about 2 emu/gram to about 30 emu/gram comprised of toner resin particles, pigment particles, and a low optical density superparamagnetic polymer comprised of an ion exchange resin containing trapped within its matrices a magnetic component species.

14 Claims, No Drawings

DEVELOPER COMPOSITION CONTAINING SUPERPARAMAGNETIC POLYMERS

BACKGROUND

This invention is generally directed to improved developer compositions, and more specifically the present invention is directed to single component color toner compositions containing superparamagnetic polymers. The single component toner compositions of the present invention in one embodiment contain resin particles, pigment and/or colorant particles and a low optical density superparamagnetic polymer. These highly transparent color magnetic toner compositions are useful for developing color images, and in particular for obtaining color highlight images in magnetic imaging systems.

Colored developer compositions comprised of resin particles, carrier particles, and pigments consisting of magenta, cyan, and/or yellow materials are well known, reference for example, U.S. Pat. No. 4,066,563. There is disclosed in this patent color developing compositions containing certain specific cyan, magenta and yellow pigments, which developer compositions when employed together with specific carrier materials are found to be highly useful in developing color images. The intensity of the color desired is dependent not only on the concentrations of the pigments selected but on other factors, including the carrier material selected and the specific composition of the pigment added to the toner resin. Thus, for example, certain types of yellow pigments when used with magenta and cyan pigments result in colored images containing a certain yellow intensity, for example, the yellow might be classified as a light yellow as compared to a bright yellow. Similarly, when certain red pigments are selected for incorporation into the toner composition, there can result developed images of low or high red intensity, that is the red color can change from light red or pink to a deep red in some instances.

These known developer compositions can be selected for developing colored images in xerographic imaging devices especially those referred to in the art as electrostatic imaging systems. In these systems, separate electrostatic latent images are developed in sequence with a developer composition containing for example, a magenta pigment, followed by development with a developer composition containing a yellow pigment, followed by development with a developer composition containing a cyan pigment. The resulting images are then transferred to a suitable support surface and permanently affixed thereon. These systems can be complex in that they require the superimposition of images with three separate exposures, on an imaging member of sufficient circumference or length to accommodate three successive images prior to transfer. Also, it is known to use in such systems a series of three separate inregister photoreceptor drums, each contributing one image to the final transfer sheet, however, such a system is costly, can result in images of poor resolution in view of the complexity of the system and the ned for three separate photoreceptor drums.

In the simpler known functional color imaging systems, generally only two colors need to be reproduced, although more than two can be obtained if desired. For example, in these systems, there is produced two color functional color documents wherein for example, black may be used to represent the main text and red or blue selected portions of the text, figures and like, which portions are directed to a users special attention by means of highlight color. In such systems, there can be obtained images in two colors such as red and black, desirably employing only one imaging operation. In many instances, full color copying is not desired since, for example, the documents being copied such as accounting documents and other business documents, contain colors of black and red only, in addition to white background. Illustrative examples of documents that may be selected for the highlight color process include technical journals such as *Scientific American,* a large portion of whose spaces are printed in black, and highlight color, engineering drawings, letters, reports, and a variety of other documents created by color ink, crayon, signature impression stamps, typewritter ribbons, and the like. These imaging systems are electrostatic and not magnetic in nature.

There is described in U.S. Pat. No. 4,189,224 a method to obtain a two color image with only a single exposure. More specifically, there is disclosed in this Patent a two color electrostatic copying apparatus which can be operable for one color positive or negative copy. In accordance with the teachings of this patent, a photoconductive material containing a conductive substrate, an inner photoconductive layer sensitive to visible light, and an outer photoconductive layer insensitive to red light, is subjected to an electrostatic charge, which charge is applied to the outer layer, while simultaneously irradiating the device with light so as to render one of the layers conductive. Subsequently, an electrostatic charge of opposite polarity is applied to the outer layer of the photoresponsive member, this step being accomplished in the dark. A light image of an original document is then projected onto the outer layer of the photoresponsive device where white areas of the image cause photoconduction of both layers and the red areas result in photoconduction of only the inner layer. Accordingly, as a result, white areas of material have zero surface potential, while red and black areas have non-zero surface potential of opposite polarities. These images can then be developed by selecting, for example, red and black toner particles of opposite charge.

Also, there is disclosed in U.S. Pat. No. 2,864,333 single component developer compositions, that is, those that do not contain carrier particles. In this patent there is described the use of a magnetic brush system to apply toner particles formed of ferrites and a resin material to an image bearing material, wherein the image contained thereon is developed. Difficulty is encountered with this process in that the conductivity of the resulting toner particles renders electrostatic transfer difficult. However, these processes have been used commercially, wherein special papers such as coated zinc oxide papers are used. Single component toner compositions are also disclosed in U.S. Pat. No. 3,639,245. Additionally there is disclosed in U.S. Pat. No. 4,108,706 a magnetic toner containing specific parameters, while U.S. Pat. No. 4,145,300 discloses developers containing magnetic particles and certain types of dyes, and U.S. Pat. No. 4,146,494, describes single component powders which have incorporated therein finely divided water insoluble quaternary ammonium salts.

Further, there is described in U.S. Pat. No. 4,238,558 low density magnetic polymer carrier materials containing a polymer material impregnated with a magnetic elemental metal or metal oxide of a transition metal carbonyl. According to the disclosure of this patent, the carrier particles are prepared by placing in a suitable vessel particles of the polymer material, a suspending medium, and a transition metal carbonyl, heating the mixture with agitation for the purpose of thermally decomposing the transition metal carbonyl causing the polymer to be impregnated with the magnetic elemental metal or metal oxide of a transition metal carbonyl, followed by cooling.

Moreover, there is disclosed in U.S. Pat. No. 4,150,173 a process for preparing transparent colored magnetic materials by for example, heating a mixture of a silicaceous material, a suspending medium, and a transition metal carbonyl, wherein the silaceous material is coated with the magnetic elemental metal of the transition metal carbonyl.

While the above described developing compositions are useful for their intended purposes, there continues to be a need for improved color developer compositions. Additionally there is a need for transparent single component developer compositions which have magentic properties. Additionally there is a need for developer compositions having high magnetic strength and excellent color saturation. Furthermore, there continues to be a need for developer compositions having high magnetic strength and excellent color saturation that are fusible or otherwise fixable to appropriate substrates such as paper.

SUMMARY OF THE INVENTION

It is an object of the present invention to provide colored developer compositions which overcome the above-noted disadvantages.

In another object of the present invention there are provided color developer compositions possessing high magnetic strength and superior color saturation.

In a further object of the present invention there are provided transparent magnetic color single component toner compositions.

In still another object of the present invention there are provided magnetic single component toner compositions containing a low optical density superparamagnetic polymer of high magnetic strength and superior color saturation.

In yet a further object of the present invention there are provided single component magnetic toner compositions useful for producing highlight color images. In still a further object of the present invention there are provided processes for the preparation of the superparamagnetic polymer selected for use in the developer compositions described. Also in another object of the present invention there are provided magnetic color imaging systems, wherein highlight color is achievable.

These and other objects of the present invention are accomplished by the provision of a single component developer composition comprised of resin particles, pigment particles, and a superparamagnetic polymer. More specifically, in one embodiment, the present invention is directed to a transparent single component magnetic toner composition comprised of fusible thermoplastic resin particles, red, green, blue, cyan, magenta or yellow pigment particles and a low optical density superparamagnetic polymer material as illustrated hereinafter. Also included within the scope of the present invention are methods for obtaining colored magnetic images by forming a magnetic latent image on a recording member, followed by developing this image with the single component transparent magnetic toner composition disclosed herein, and comprised in one embodiment of resin particles, pigment particles, and a superparamagnetic polymer.

The low optical density superparamagnetic polymers incorporated into the toner compositions of the present invention are generally comprised of polymer resins, such as known ion exchange resins which have been crosslinked, and contain within the polymer matrices, magnetic particles such as iron oxide particles. These crosslinked ion exchange resins, which are commercially available, for example, may be sulfonated or carboxylated, and include for example, commercially available sulfonated polystyrenes. The sulfonate or carboxylate sites have attached thereto a cation component such as sodium, Na+ or hydrogen, H+, and the like. Subsequently, the cations are replaced by ferric or ferrous ions in the proper stoichiometry followed by a reduction or oxidization of the resulting compositions in basic solutions, wherein there results the superparamagnetic polymer component for the toner composition of the present invention. As this process involves treatment with basic solutions, as illustrated herein, the ion exchange resin is regenerated to the orginal cationic (Na+) polystyrene containing therein in the matrices the magnetic material in the form of an oxide, such as for example, ferric oxides, particularly gamma ferric oxide particles.

The low optical density superparamagnetic polymers incorporated in the developer compositions of the present invention are preferably comprised of known polystyrenes containing for example the crosslinking agent divinylbenzene in an amount of from about 1 to about 16 percent by weight, with sulfonic acid exchange groups attached to the styrene divinylbenzene polymer lattice for the purpose of providing an exchange capacity ranging from about 1 to about 6 milliequivalents per gram of dry resin particles. These sulfonic acid resins are generally considered strong acids, and further these resins readily exchange their ionic protons, H+, for ferrous Fe++, or ferric Fe+++ ions. Subsequent treatment of the resulting ion loaded material with oxidizing or reducing agents in basic aqueous solutions with heat produces particles of iron oxide, specifically, for example, gamma, ferric oxide particles, in the polymer lattice.

Reference to the following equations and accompanying explanation further describes specifically the low optical density superparamagnetic polymers useful in the present invention.

Intially the acidic form of the crosslinked sulfonated polystyrene resin is treated with iron chloride in order to produce the ion loaded form divinylbenzenepolystyrene $(SO_3)_n(Fe_{n/a})$, wherein n is a number greater than 3, and a is a number of from about 2 to 3.

For ferrous chloride loading, the exchange may be illustrated as: polystyrene $-(SO_3^-H^+)_2+Fe^{++}$ resulting in the polystyrene $(SO_3^-)_2Fe^{++}$ plus $2H^+$. Similarly, the ferric chloride loading process can be illustrated by the following equation:

polystyrene $-(SO_3^-H^+)_3+Fe^{+++}$ yield polystyrene $-(SO_3^-)_3Fe^{+++}$ plus $3H^+$.

Conversion of the iron-ion loaded resin to the iron oxide loaded resin proceeds in accordance with the following illustrative equation for the iron +2 and iron +3 situations respectively:

1. polystyrene —$(SO_3)_2Fe^{++}$ plus $NaOH+H_2O_2+$-heat, water, yields polystyrene —$(SO_3Na^+)_n$+gamma$Fe_2O_3$ 2. polystyrene —$(SO_3^-)_3Fe^{+++}$ plus $N_2H_4+NaOH$+heat, water, yields polystyrene —$(SO_3Na^+)_n$+gamma$Fe_2O_3$, wherein n is as defined herein, and wherein the gamma oxide particles are uniformly dispersed throughout the polymer matrix in small particle size forms generally not exceeding about 250 Angstroms in diameter.

Illustrative examples of ion exchange resins include those polymers possessing chemically addressable sites dispersed throughout their matrix, or on their surface, which sites can be used to either generate a magnetic component in situ or cause the chemical binding of various chromaphores to achieve the desired color. Specific examples of these resins include sulfonated polystyrenes, strongly acidic phenolics, R—$CH_2SO_3^-H^+$, weakly acidic acrylics, R—$COO^-Na^+$, wherein R is an alkyl group, weakly acidic chelating polystyrenes, and the like, with strongly acidic sulfonated polystyrenes being preferred. Other suitable polymers can be selected provided they are of a low optical density, have a non interferring color, and the like, including for example, any resins containing cation exchange species, providing the objectives of the present invention are achieved.

Generally, these polymers are available in the form of small spheres, or beads ranging in size of from about 500 dry mesh to about 25 dry mesh, and preferably from about 400 dry mesh to about 200 dry mesh. These polymers when containing a magnetic species are referred to herein as low optical density superparamagnetic polymers.

Examples of cations contained in the polymer matrix inlcudes those derivable from transition metal ions such as iron, cobalt, nickel, manganese, vanadium, chromium, and the like, with iron being preferred. These cations generally exist in the form of the chlorides of the metal involved such as ferrous chloride, ferric chloride, copper chloride, nickel chlorides, and the like, although the corresponding iodides, bromides and fluorides may also be suitable. Other sources of the cation include for example, soluble salts such as water soluble iron acetate, nitrate, perchlorate, sulfate, thiocyanate, thiosulfate, nickel acetate, cobalt acetate, and the like.

The cation species of the transition metal is generally present in the polymer matrix so as to result in a solid particle which has magnetic properties. In one embodiment for example, the magnetic resin contains about 1 weight percent to about 10 weight percent, and preferably from about 5 weight percent to about 8 weight percent of the cationic species in the form of an oxide. Accordingly, the polymer involved is present in an amount of from about 99 weight percent to about 90 weight percent, and preferably from about 95 weight percent to about 92 weight percent.

The composite low optical density superparamagnetic polymer composite particles of the present invention have a magnetic saturation moment ranging from about 2 to about 30 emu/gram and preferably from 15 emu/gram to about 25 emu/gram. By magnetic saturation moment is meant the magnetic moment per unit mass designated in emu/gram at which time the microscopic magnetic moments (domains) of the measured sample are aligned in the direction of an applied field. The saturation moments are obtained in field of about 10,000 gauss at room temperature with a vibrating sample magnetometer which measures the magnetization of a sample at a given field at the desired temperature.

Although it is not desired to be limited by theory, it is believed that the composite particle contains the cation in the form of its corresponding oxides within the polymer matrix, the oxide being permanently contained in the matrix in view of its confinement by constiuents of the polymer network, including the polymer backbone, and crosslinking. Additionally, it is believed that the cationic oxide particles are encased in the polymer matrix and thus are prevented from escaping therefrom in view of the blocking action of the specific components of the polymeric network. Direct evidence that the cationic oxide is contained in the polymer matrix was obtained from transmission electron photomicrographs orginating from a transmission electron microscope at magnifications of between 10,000 and 400,000 X-magnification of the resulting low optical density superparamagnetic polymer. More specifically, the superparamagnetic polymer contains the above components as evidenced by electron and x-ray diffraction measurements, Mossbauer spectroscopy, ultra-violet and visible electronic absorption spectral data and from temperature and field dependent magnetic measurements performed on a vibrating sample magnetometer.

The low optical density superparamagnetic polymer of the present invention is present in the single component developer composition in an amount of from about 10 percent to about 60 percent and preferably in an amount of from about 30 percent to about 50 percent. Generally, the superparamagnetic polymer is incorporated into the toner composition by thoroughly milling from about 30 parts by weight to about 50 parts by weight of the specific polymer involved with about 70 parts by weight to about 50 parts by weight of the toner resin particles. This mixing is continued until a uniform mixture of resin particles and superparamagnetic polymer particles are obtained as evidenced by a zero change in viscosity during the hot melt blending of the components and by photooptical and electron micrographs of the resulting samples.

The superparamagnetic polymers useful in the present invention can be prepared by a number of methods. One specific method involves subjecting a crosslinked sulfonated polystyrene resin to a reaction with a chloride of the cation desired, such as ferric chloride, at room temperature for a sufficient period of time so as to cause the cationic groups contained in the polymer to be replaced by the ferric ions. This results in ferric ions at the sites previously occupied by the $Na^+$ or $H^+$ groups. The resulting composition is then reacted thereby resulting in the formation of a magnetic species in the resin.

During the reaction basic solutions are used, which solutions also cause evaporation of the sulfonated polystyrene containing within its matrices iron oxide particles. The regeneration is generally accomplished at room temperature, or when in combination with the oxide formation process from about 20° C. to about 60° C. Moreover, in order to allow for the oxidation, and regeneration to proceed to completion, mechanical agitation of the aqueous suspension of the resin particles is needed for sufficient period of time ranging from about 10 hours to about 30 hours, which agitation can be accomplished by known means. Additionally, a suitable oxidizing or reducing agent such as hydrogen peroxide, 4 percent by weight, or other similar materials which will accomplish the same purpose, such as hydrazine are selected in order to convert the ionic iron to the desired oxide in the polymer.

Various suitable resins can be selected for the toner composition of the present invention, typical resins being for example, polyamides, epoxies, polyurethanes, vinyl resins, and polyesters, espeially those prepared from dicarboxylic acids and diols comprising diphenols. Any suitable vinyl resin may be employed in the toners of the present system, including homopolymers or copolymers of two or more vinyl monomers. Typical of such vinyl monomeric units include: styrene, p-chlorostyrene, vinyl naphthalene, ethylenically unsaturated mono-olefins such as ethylene, propylene, butylene, isobutylene and the like; vinyl halides such as vinyl chloride, vinyl bromide, vinyl fluoride, vinyl esters such as vinyl acetate, vinyl propionate, vinyl benzoate, vinyl butyrate and the like; esters of aliphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalpha-chlorofluoride and the like; and N-vinyl indole, N-vinyl pyrrolidone and the like; and mixtures thereof.

Generally, toner resins containing a relatively high percentage of styrene are preferred. The styrene resin employed may be a homopolymer of styrene, or styrene homologs of copolymers of styrene with other monomerix groups. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic, and cationic polymerization processes. Any of these vinyl resins may be blended with one or more resins if desired, preferably other vinyl resins, which insure good triboelectric properties and uniform resistance against physical degradation. However, non-vinyl type thermoplastic resins may also be used including resin modified phenolformaldehyde resins, oil modified epoxy resins, polyurethane resins, cellulosic resins, polyether resins, and mixtures thereof. Optimum electrophotographic resins are achieved with styrene butylmethacrylte copolymers, styrene vinyl toluene copolymers, styrene acrylate copolymers, polyester resins, predominantly styrene or polystyrene base resins as generally described in U.S. Pat. No. Re. 25,136, polystyrene blends as described in U.S. Pat. No. 2,788,288, and styrene-butadiene resins.

Also esterification products of a dicarboxylic acid, and a diol comprising a diphenol may be used as a preferred resin material for the toner composition of the present invention. These materials are illustrated in U.S. Pat. No. 3,655,374 the disclosure of which is totally incorporated herein by reference, the diphenol reactant being of the formula as shown in Column 6 of the above patent.

There can be selected as pigments, known magenta, cyan, yellow pigments and mixtures thereof, as well as red, green, or blue pigments, or mixtures thereof, and the like.

Illustrative examples of magenta materials that may be used as pigments, include for example, 2,9-dimethyl-substituted quinacridone and anthraquinone dye identified in the color index as CI 60710, CI Dispersed Red 15, diazo dye identified in the color index as CI 26050, CI Solvent Red 19, and the like. Illustrative examples of cyan materials that may be used as pigments include copper tetra-4(octadecyl sulfonomido) phthalocyanine, X-copper phthalocyanine pigment listed in the color index as CI 74160, CI Pigment Blue, and Anthradanthrene Blue, identified in the color index as CI 69810, Special Blue X-2137, and the like, while illustrative examples of yellow pigments that may be employed include diarylide yellow 3,3-dichlorobenzidene acetoacetanilides, a monoazo pigment identified in the color index as CI 12700, CI Solvent Yellow 16, a nitrophenyl amine sulfonamide identified in the color index as Foron yellow SE/GLN, CI dispersed yellow 33, 2,5-dimethoxy-4-sulfonanilide phenylazo-4'-chloro-2,5-dimethoxy aceto-acetanilide, permanent yellow FGL, and the like.

Illustrative examples of red materials useful as pigments include, cadmium red 150K, C.I. pigment red 108; lithol red, C.I. pigment red 49; lithol scralet, C.I. pigment red 4301L; toluidene red, C.I. pigment red 3; and the like, while examples of useful green pigments include, chrome green, C.I. pigment green 15; chrome green lake, C.I. pigment green 18; chrome intra green, C.I. pigment green 21; phthalocyanine green, C.I. pigment green 7, and the like. Examples of useful blue pigments include, phthalocyanine blue, C.I. pigment blue 15; prussion blue C.I. pigment blue 27, ultramarine blue, C.I. pigment blue 29, and the like.

The color pigments, namely, red green blue, cyan, magenta, and yellow pigments are generally present in an amount of from about 2 weight percent to about 20 weight percent, and preferably from about 5 weight percent to about 15 weight percent based on the weight of the toner resin particles.

The resulting single component color magnetic toner is useful for causing the development of magnetic images in that the toner has a magnetic saturation moment ranging from about 10 to about 20 emu/gram. Thus, there is envisioned in accordance with the present invention a method for developing and forming colored magnetic images which comprises forming a magnetic image on a suitable recording surface, developing the image with the single component developer composition of the present invention, followed by optionally transferring the image to a suitable substrate and permanently affixing the image thereon by fusing or other fixing means. Illustrative examples of supporting substrates that may be selected for forming the magnetic image include those commonly known in the art such as magnetic tapes of chromium dioxide, iron oxide, and the like.

Additionally, as recording surfaces for forming the magnetic image, there can be selected various photoconductive imaging devices including layer devices comprised of generating layers and transporting layers as disclosed for example in U.S. Pat. No. 4,239,990, the disclosure of which is totally incorporated herein by reference. Examples of specific generating layers include metal phthalocyanines, metal free phthalocyanines, vanadyl phthalocyanine, and the like while examples of transport layers include diamines dispersed in inactive resinous binder materials which diamines are of the formula as detailed in U.S. Pat. No. 4,239,990. The developer compositions of the present invention are particularly useful in causing the formation of highlight magnetic images incorporating a color different from the usual or expected black or brown color, and are useful for highlight coloring.

Specifically in one development sequence, there is formed a red highlight image by the following specific process: Initially a 70 micron wavelength chromium dioxide recording tape containing the desired tape image in latent form is dusted with a red magnetic toner of the present invention for the purpose of developing the image. The red magnetic toner is magnetically retained on the image areas of the tape only. Subsequently, the tape with the developed image thereon is placed face down upon ordinary plain bond paper and the image suitable transferred to the paper by cold pressure fix transfer by for example, directing the tape paper fixture through pressure rollers. The transferred red image, can be fixed by fusing, lacquering and the like.

The superparamagnetic polymeric compositions disclosed herein can be surface treated with various suitable additives for the purpose of enhancing dispersibility of these compostions, and modifying the triboelectric charging characteristics thereof. Examples of additives that may be selected include known quaternary ammonium salt compositions, organic silanes, and the like.

The following examples are being supplied to further define certain embodiments of the present invention, it being noted that these examples are intended to be illustrative only and are not intended to limit the scope of the present invention. Parts and percentages are by weight unless otherwise indicated.

EXAMPLE I

There was prepared a low optical density superparamagnetic resin, identified herein as (LODSPM) by mixing and reacting the appropriate components in a 4 liter glass beaker equipped with a suitable glass cover (190×100 ml Pyrex recrystallizing dish), a 3 inch magnetic stirring bar and a Corning hotplate stirrer. As the ion exchange resin there was selected a sulfonated polystyrene resin commercially available from J. T. Baker Inc., as CGC-241, 200–400 mesh, which resin was used in the form of the sodium salt. During the resin washing and preparation steps, the beaker was filled with water (de-ionized) and the contents stirred. The composition remained stationary allowing particles to settle and subsequently the mixture was decanted. The preparation sequence that follows relates to obtaining one batch of material wherein the sulfur to iron ratio was 3:1.

In a 4 liter beaker there was charged 1.5 pounds of the CGC-241 resin, subsequent to removing from the resin, various impurities by washing with de-ionized water until the resulting effluent is clear and nearly colorless. Subsequently, the resin was then washed with hydrochloric acid, 1 normal, containing 95 percent of ethanol, followed by de-ionized water washing until the resulting effluent is colorless and has a neutral pH. A final washing was accomplished in aqueous sodium hydroxide, 1 normal, followed again by a de-ionized water washing until the resulting mixture had a neutral pH.

The CGC-241 resin obtained subsequent to the washings was now treated with a ferric chloride solution prepared by adding 2 pounds of $Fe_3Cl_3.6H_2O$ to one liter of water and filtering rapidly through a 32 centimeter Whatman folded paper No. 2V. The iron solution was added directly to the purified resin simultaneously with a sufficient amount of water in order to completely substantially fill the beaker.

The resulting suspension was then stirred for 2 hours after which the solution was decanted and the resulting resin washed with de-ionized water which washings are continued until no ferric iron remained in the effluent, as determined by the absence of a deep red color when treated with a slightly acidic aqueous solution of potassium cyanide. The deep red color results from the formation of several thiocyanto complexes of iron with a valence of 3.

The resin was then suspended in a full beaker, 3.8 liters of water, stirred and heated to 60° C. on a hotplate stirrer in a ventilated hood. Hydrazide, 100 milliliters, 95 percent purity, available from Eastman Kodak Company as Eastman 902, was then added dropwise to the suspension over a period of an hour while the temperature was maintained at 60° C. During this period, the suspension was converted from a brown color to black and $NH_3$ was emitted. When the addition of hydrazine was complete, 100 milliliters of water containing 80 grams of sodium hydroxide was added directly to the resin suspension, followed by heating and stirring for about 24 hours. Subsequently, the soution is decanted and the resin washed with de-ionized water until a neutral pH is obtained.

The resin was then recovered in a 2 liter glass fritted filter and placed in a drying oven, at a temperature of 120° C. for about 16 hours. During this period, the black resin changes color to an amber red and the resulting beads which now contain iron oxide are optically transparent and have a lusterous appearance.

A fine powder of magnetic polymer resin was obtained by micronizing the 200 to 400 mesh polymer beads by milling. With the resin containing about 5 meq/gram total exchange capacity on the dry basis, the weight percent loading of iron oxide, $Fe_2O_3$ was about 12. At room temperature, the iron oxide containing polymer had a magnetic strength of about 9 emu/grams and was superparamagnetic as evidenced by the absence of any hysteresis in the magnetization curves.

EXAMPLE II

A more strongly magnetic low opticaldensity superparamagnetic resin with an increased ratio of iron to sulfur was prepared by repeating the procedure of Example I.

The Baker anion exchange resin CGC-241 was cleaned and washed as described in Example I above. Sixty grams of the resin was then saturated with an aqueous ferrous chloride solution in the presence of 0.1 gram iron powder to insure the presence of iron in the +2 or ferrous state. The resin was then rinsed until all excess iron salt was removed and resuspended in 500 ml of a 1N NaOH solution. The mixture was stirred and heated to about 65° C. whereupon aqueous hydrogen peroxide was added drop by drop until bubbling ceases. The resin was then rinsed thoroughly with deionized water and placed in a drying oven (120° C.) overnight. During this period, the dark resin changes to an amber red and the beads, which now contain iron oxide are optically transparent, clear and have a lustrous appearance. A fine powder of magnetic polymer resin was obtained by micronizing the polymer beads in a Jetomizer 0202 attritor. For a resin containing about 5 meq/gram total exchange capacity on the dry basis, the weight percent loading of iron oxide, $Fe_2O_3$ was about 17. Thus, with a single pass, 1.5 times as much iron oxide results, in comparison to Example I, with the use of Fe+2 as with Fe+3 since less sulfonated sites are required for the former iron. The magnetic polymer thus formed has a saturation moment at room temperature of about 13 emu/grams, 17 percent by weight of iron oxide, as determined by vibrating sample magnetometer measurements.

EXAMPLE III

A greater loading of iron or iron oxide was achieved by consecutively repeating the process of Examples I or II.

A 4 liter beaker was charged with 1.5 pounds of the sulfonated polystyrene magnetic resin prepared in Example I. The magnetic polymer resin was then saturated with iron (III) by treating it with 3.5 liters of water, containing about 2 pounds $FeCl_3.6H_2O$ in the dissolved form. This suspension was stirred for 2 hours after which the solution was decanted and the resin washed with $H_2O$ until no $Fe_3+$ remains in the effluent. The resin was then suspended in a full beaker of water, stirred and heated to 60° C. on the hot plate stirrer in a properly ventilated hood. Subsequently 100 ml of 95+ percent hydrazine (Eastman 902) were added dropwise to the suspension over a period of an hour with the temperature kept at 60° C. When the addition of $N_2H_4$ was complete, 100 ml of $H_2O$ containing 80 grams NaOH was added directly to the resin suspension which was stirred, heated and open to the air. Heating and stirring were continued for about 16 hours. After stirring, the solution was decanted and the resin washed to a neutral pH. A similar heat treatment was accomplished as described in Examples I or II during which the black magnetic resin turns amber in color due to conversion of the iron oxide to the gamma form. For a resin containing 5 meq/gram total exchange capacity and treated as in Example I, the loading of iron oxide in the gamma form was 21 percent by weight. Micronization of this magnetic resin results in a strongly magnetic fine powder having a room temperature moment of about 19 emu/gram. Transmission electron microscopy shows the iron oxide to be present as 100 to 200 Angstroms sized particles.

EXAMPLE IV

An increased greater magnetic loading was achieved by repeating the process described in EXAMPLES I and II on the magnetic resin as prepared in Example III. Specifically two pounds of the magnetic resin prepared in accordance with the process of Example III were placed in a 4 liter beaker filled with de-ionized water. The resin was then saturated with an iron (III) chloride solution as in Example I, and washed clean. The resin was then suspended in a 4 liter beaker full of water, followed by stirring, and heating to about 60° C. Treatment with hydrazine was now carried out as described in Examples I or III. After the reaction the resin was washed thoroughly to a neutral pH. The black magnetic resin, now containing three loadings of iron oxide was heated in an oven as described in Example I whereupon an amber colored resin results. The resulting magnetic resin contains 5 meq/gram total exchange capacity, and approximately 29 percent $Fe_2O_3$ by weight. Magnetic measurements of this resin show saturation moments of about 21 to 22 emu/gram with no hysteresis in the magnetization curve. Electron microscopy reveals a 100 to 200 Angstrom fine particle suspension of iron oxide in the polymer network.

Micronization of this magnetic resin is achieved with little effort due to the high loading of iron oxide in the crosslinked 241 resin. Optically, the whole beads appear clear and lustrous.

EXAMPLE V

A further increased loading of iron oxide was achieved by repeating the procedure of Example IV on the polymer obtained in Example II, resulting in an iron oxide loading of 30 percent. The magnetic resin was amber in color, and had a magnetic saturation moment of 26 emu/gram.

EXAMPLE VI

A superparamagnetic polyer was prepared with the weak acid cation exchange resin Bio-Rex 70 available from Bio Bad Laboratories, Richmond, Califor. Bio-70 is a weakly acidic, acrylic resin of the type R-COO−Na+. One hundred grams of clean Bio-70 resin were suspended in 4 liters of water, and saturated with a iron (III) chloride solution as described in Example I. The resin was then washed with pure water until no traces of iron were found. In accordance with Example I the resin was then treated with 25 ml of hydrazine, and subjected to heat resulting in an amber colored superparamagnetic resin with a magnetic moment of about 6 emu/gram.

A bright red colored magnetic toner was prepared by mechanically mixing 23 grams of the above prepared superparamagnetic resin, 43 percent loading, with 22 grams of XP resin, and 8.5 grams of lithol scarlet red pigment. The mixture was melt blended in a Plastigraph, and micronized on a Jetomizer 0202. The resulting toner was bright red in color and magnetic, having a saturation moment of about 4 emu/gram.

Magnetographic images were then generated by imagewise exposing to UV light a 70 micron wavelength chromium dioxide tape, and these images were then developed with the above prepared toner composition. Subsequently the images were cold pressure transferred to plain paper, and fused resulting in a red highlight color image.

A xerographic image was also generated by forming a latent image on a selenium photorecptor, and this image was developed with a magnetic brush formed from the above prepared toner particles, and a bar magnet.

EXAMPLE VII

The procedure of Example I was repeated with a polymer containing a lower crosslinkage than the polymer of Example I. Thus Bio-Bad AG50W-X4 which contains 4 percent divinylbenzene as a crosslinking agent versus 8 percent for the polymer of Example I, was treated in the manner described in Example I, and there resulted a superparamagnetic polymer having a saturation moment of 10 emu/gram. Micronization of the resulting polymer beads was readily accomplished in view of less crosslinking in the polymer.

A brightly colored magnetic toner composition consisting of a mechanical mixture of 32 grams of a styrene n-butylmethacrylate copolymer resin, containing 58 percent by weight of styrene and 42 percent by weight of butylmethacrylate, designated as XP, 44 grams of the above prepared superparamagnetic polymer, 4 grams of Hostaperan Pink-E, 1 gram of Silanox grade 101, and 0.5 grams cetylpyridine chloride was prepared and roll milled in a jar for about 2 hours. This mixture was then melt-blended on a two-roll rubber mill and pre-ground using a hammermill. The resulting coarse particulate composition was micronized to toner size, about 10 microns, on a Sturtevant Fluid Energy mill. There was obtained a bright magenta magnetic toner with a magnetic moment of 4 emu/gram.

Magnetographic image were then generated by imagewise exposing to UV light a 70 micron wavelength chromium dioxide tape, and these images were then developed with the above prepared toner composition. Subsequently the images were cold pressure transferred to plain paper, and fused resulting in a magenta highlight color image.

A xerographic image was also generated by forming a latent image on a selenium photorecptor, and this image was developed with a magnetic brush formed from the above prepared toner particles, and a bar magnet.

EXAMPLE VIII

The procedure of Example VII was repeated with the exception that the polymer which has less crosslinking was Bio-Rod AG50W-X2, containing 2 percent divinylbenzene resulting in a magnetic polymer substantially similar to the polymer of Example VII.

EXAMPLE IX

A brightly colored magnetic toner composition consisting of a mechanical mixture of 32 grams of a styrene n-butylmethacrylate copolymer resin, containing 58 percent by weight of styrene and 42 percent by weight of butylmethacrylate, designated as XP, 44 grams of the magnetic polymer resin of Example III, 4 grams Hostaperan Pink-E, 1 gram of Silanox grade 101, and 0.5 grams cetylpyridine chloride was prepared and roll milled in a jar for about 2 hours. This mixture was then melt-blended on a two-roll rubber mill and pre-ground using a hammermill. The resulting coarse particulate was micronized to toner size on a Sturtevant Fluid Energy mill. There was obtained a bright magenta magnetic toner.

Magnetographic images were then generated by imagewise exposing to UV light a 70 micron wavelength chromium dioxide tape, and these images were then developed with the above prepared toner composition. Subsequently the images were cold pressure transferred to plain paper, and fused resulting in a magenta highlight color image.

A xerographic image was also generated by forming a latent image on a selenium photorecptor, and this image was developed with a magnetic brush formed from the above prepared toner particles, and a bar magnet.

EXAMPLE X

A bright red colored magnetic toner was prepared by mechanically mixing 23 grams of the resin of Example III, 43 percent loading, with 22 grams of XP resin, and 8.5 grams of lithol scarlet red pigment. The mixture was melt blended in a Plastigraph, and micronized on a Jetomizer 0202. The resulting toner was bright red in color and magnetic, having a saturation moment of about 8 emu/gram.

The above prepared toner was then used to develope both magnetic images, and xerographic images by repeating the procedure of Example IX, and similar results were obtained.

EXAMPLE XI

A colored magnetic toner formulation was prepared by mechanically mixing 20 grams of the magnetic resin of Example III, with 30 grams of XP resin. The mixture was roll milled for one hour, and melt blended in accordance with the process of Example IX. Micronization was effected in a Jetomizer 0202 using forced air attrition. The resulting toner, which had a particle size of less than 10 microns was light tan in color, and had a magnetic saturation moment of about 7 emu/gram.

Light tan or beige images were obtained when the toner of this Example was used to develope images by repeating the imaging process of Example IX.

EXAMPLE XII

A second light tan colored magnetic toner was prepared with a 50 weight percent loading of the magnetic resin. A mixture comprising 25 grams of the magnetic resin as prepared in Example III, and 25 grams of XP resin was rolled milled, for about two minutes, until a uniformly colored powder resulted. This mixture was melt blended and micronized by repeating the procedure of Example XI. The resulting toner was tan or beige in color, and had a saturation moment of 9.5 emu/gram.

Highlight color magnetic images were obtained with this toner by repeating the imaging processing steps of Example IX.

The color of the images result from the natural color of the gamma $Fe_2O_3$, no additional colored pigment or dye being present.

EXAMPLE XIII

A very strongly magnetic bright red colored material was prepared having a magnetic saturation moment of 19 emu/gram, a 50 percent increase in magnetic loading in comparision to the materials of Examples IX–XII. The preparation consisted of treating the fineparticle ($<10$ micron) magnetic resin in Example IV, suspended in water, with an aqueous solution of rhodamine 6G dye. Rhodamine is a cationic dye containing a chromaphor in the $+1$ oxidation state. This cation replaced the cations in the resin of Example IV to form a red magnetic material. After equilibration, the resin was removed from suspension with a strong external magnet. The resulting slurry was collected by filtration and air dried.

Color magnetic images were obtained with this toner by repeating the magnetic imaging processing steps of Example IX.

EXAMPLE XIV

A low optical density superparamagnetic material was prepared containing a mixed bed ion exchange resin, by treating one hundred grams of Bio-Rod AG501-X8 containing both cationic sites, and anionic sites, in accordance with Example III. The resulting material was micronized to a fine powder that had a magnetization of about 9 emu/gram. This magnetic polymer contains both cationic and anionic sites suitable for dyeing, with the cationic site being the $-CH_2N(CH_3)_3+$ site. A sample of the above prepared material was suspended in water, and treated in the manner described in Example XIII with C.I. Acid Red dye, Monoazo. Upon washing the resin and dying, a reddish magnetic powder was obtained having a saturation moment of 9 emu/gram.

Electrostatic images can also be developed by known processes with the developer compositions of the present invention.

Other modifications of the present invention will occur to those skilled in the art based upon a reading of the present disclosure. These are intended to be included within the scope of this invention.

I claim:

1. A color magnetic single component toner composition possessing a magnetic saturation moment of from about 2 emu/gram to about 30 emu/gram comprised of toner resin particles, pigment particles, and a low optical density superparamagnetic polymer comprised of an ion exchange resin containing trapped within its matrices a magnetic material.

2. A toner composition in accordance with claim 1 wherein the ion exchange resin is a sulfonated polystyrene.

3. A toner composition in accordance with claim 1 wherein the ion exchange resin is a sulfonated polystyrene, and the magnetic material is an iron oxide.

4. A toner composition in accordance with claim 1 wherein the magnetic material is gamma iron oxide.

5. A toner composition in accordance with claim 1 wherein the magnetic material is contained in the ion exchange resin in an amount of from about 1 percent by weight to about 10 percent by weight.

6. A toner composition in accordance with claim 1 wherein the resin particles are selected from styrene methacrylate polymers, or polyester compositions.

7. A toner composition in accordance with claim 6 wherein the styrene methacrylate polymers are styrene n-butylmethacrylate copolymers.

8. A toner composition in accordance with claim 1 wherein the pigment particles are selected from red, blue, green, magenta, cyan, yellow, or mixtures thereof.

9. A toner composition in accordance with claim 1 wherein the resin particles are present in an amount of from about 90 percent by weight to about 10 percent by weight, the color pigment particles are present in an amount of from about 1 percent by weight to about 10 percent by weight, and the low optical density superparamagnetic polymers are present in an amount of from about 10 percent by weight to about 90 percent by weight.

10. A method of imaging which comprises generation a latent magnetic image, or a latent electrostatic image, developing the image with the toner composition of claim 1, and subsequently transferring the image to a suitable substrate.

11. A method of imaging in accordance with claim 10 wherein the ion exchange resin is sulfonated polystyrene, and the magnetic material is an iron oxide.

12. A method of imaging in accordance with claim 10 wherein the magnetic material is contained in the ion exchange resin in an amount of from about 1 percent to about 10 percent.

13. A method of imaging in accordance with claim 10 wherein the pigment particles are selected from red, blue, green, magenta, cyan, yellow, or mixtures thereof.

14. A method of imaging in accordance with claim 10 wherein the resin particles are selected from styrene methacrylate polymers, or polyester compositions.

* * * * *